US006789649B2

(12) United States Patent
Herrmann

(10) Patent No.: US 6,789,649 B2
(45) Date of Patent: Sep. 14, 2004

(54) ANCHOR CLAMP

(75) Inventor: Peter H. Herrmann, Hamilton (CA)

(73) Assignee: Aluma Enterprises Inc., Concord (CA)

( * ) Notice: Subject to any disclaimer, the term of this patent is extended or adjusted under 35 U.S.C. 154(b) by 0 days.

(21) Appl. No.: 10/173,807

(22) Filed: Jun. 19, 2002

(65) Prior Publication Data

US 2003/0015372 A1 Jan. 23, 2003

(51) Int. Cl.[7] ..... E04G 1/00; E04G 7/00

(52) U.S. Cl. ..... 182/186.7; 182/186.8; 403/49; 248/230.4

(58) Field of Search ..... 248/230.4, 231.51, 248/500, 499; 403/19, 373, 246; 182/186.7, 186.8, 179.1, 10, 9, 36, 3, 8

(56) References Cited

U.S. PATENT DOCUMENTS 4,426,171 A * 1/1984 Layher ..... 403/49
4,632,221 A * 12/1986 Stanford ..... 182/179.1
4,702,447 A * 10/1987 Westwood, III ..... 248/231.51
4,799,639 A * 1/1989 Riley ..... 248/231.51
4,852,840 A * 8/1989 Marks ..... 248/230.1
5,427,465 A * 6/1995 Sato ..... 403/49
6,168,345 B1 * 1/2001 Legge ..... 182/179.1 X

* cited by examiner

*Primary Examiner*—Hugh B. Thompson, II

(57) ABSTRACT

A tube and clamp scaffold system includes a series of anchor clamps which are attached by the workers during erection of the system. The anchor clamps are attached at appropriate positions to ay of the tubular members and provide a fastening connection for the hook of a safety lanyard. In this way, the worker secures anchor clamps as the system is erected and fastens his safety lanyard to the appropriate anchor clamp. As the height or length of the system increases, a new anchor clamp can be secured. The anchor clamps are fast to secure and preferably secured in the same manner as clamps used to secure the tubular members.

10 Claims, 4 Drawing Sheets

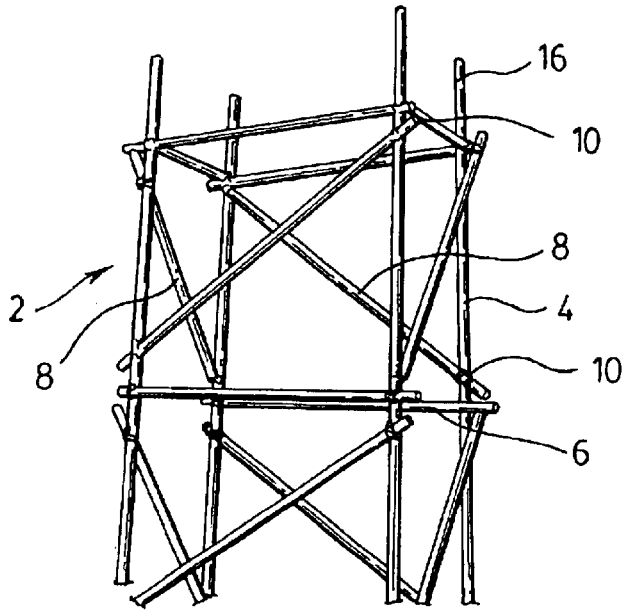
FIG. 1.
FIG. 2.
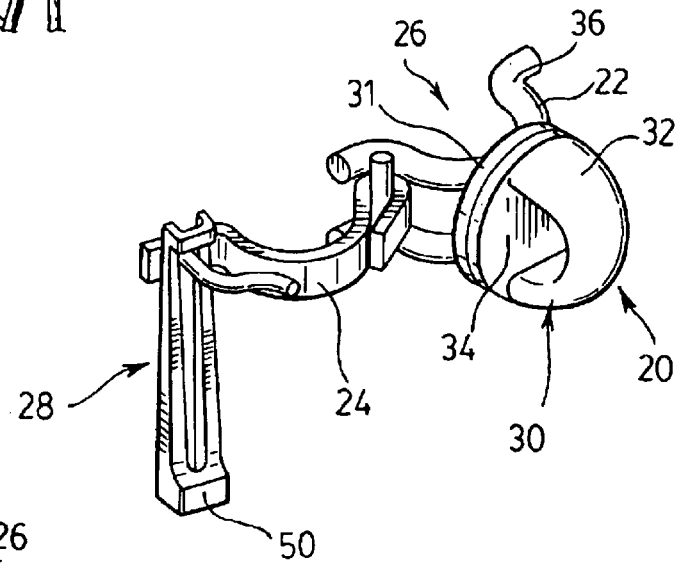
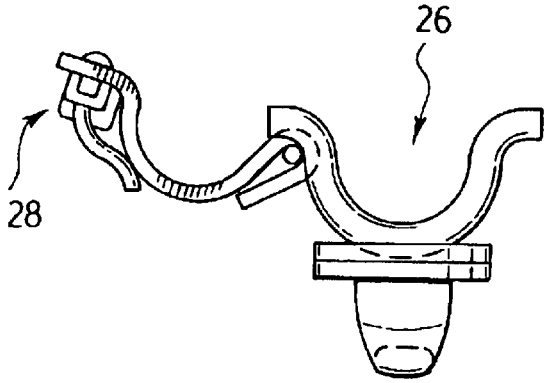
FIG. 3.

FIG. 4.
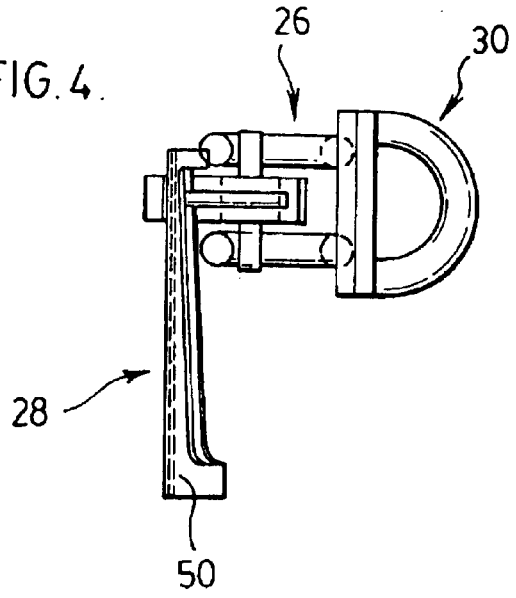
FIG. 5.
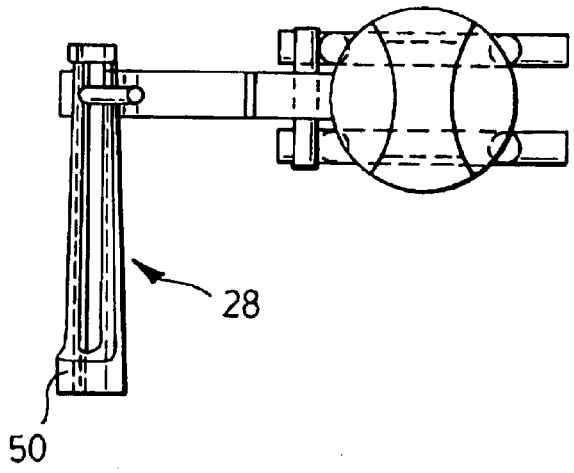
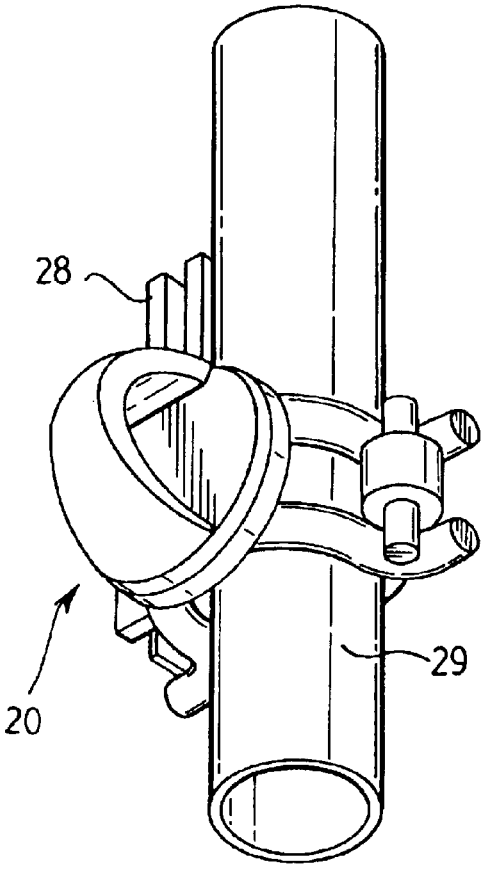
FIG. 6.

FIG. 7.
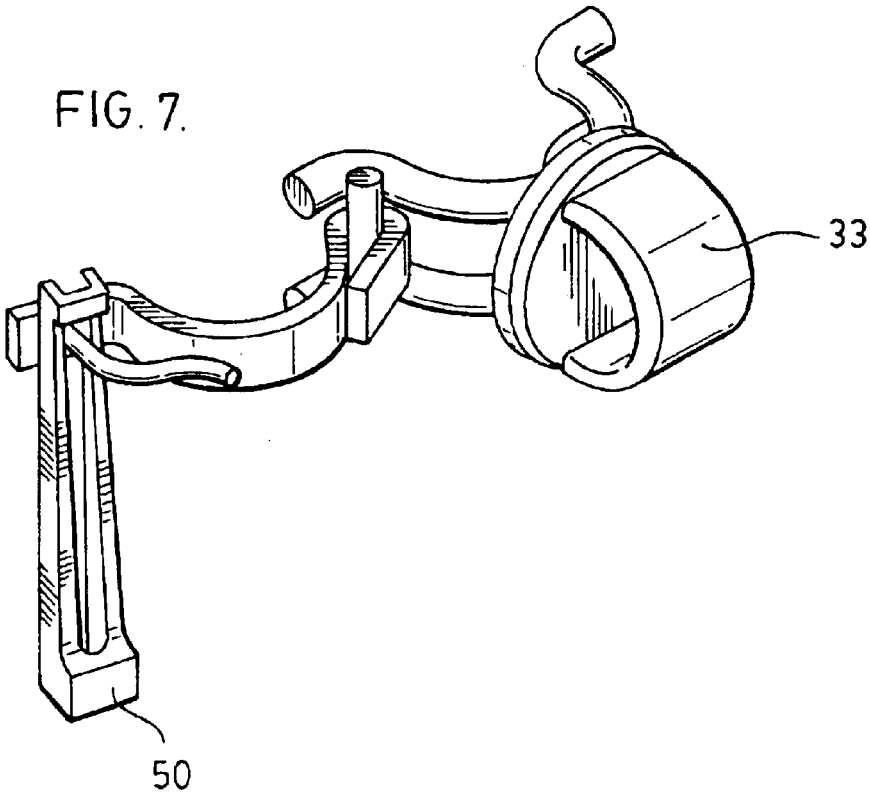
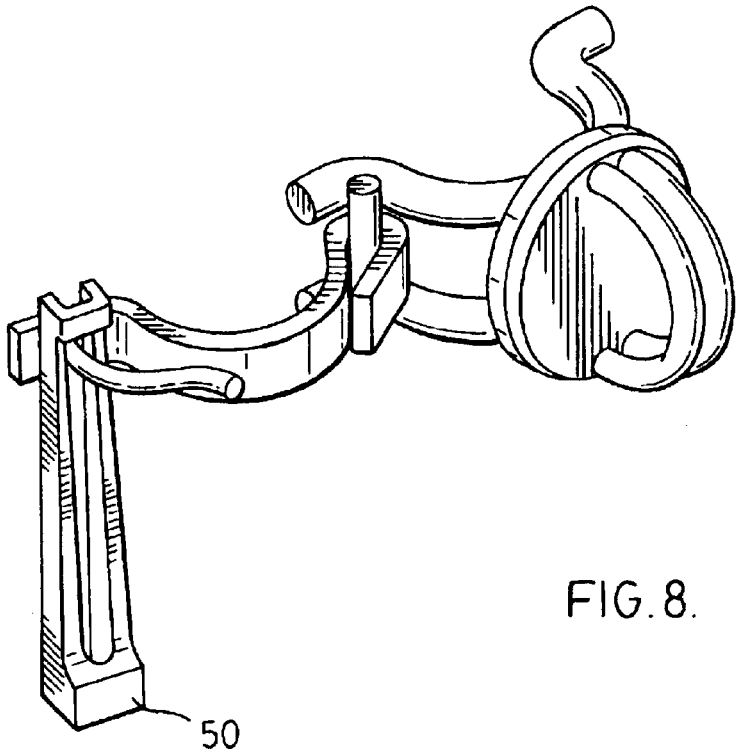
FIG. 8.

ANCHOR CLAMP

FIELD OF THE INVENTION

The present invention relates to safety restraint systems and in particular, relates to safety restraint systems for scaffold systems.

BACKGROUND OF THE INVENTION

Scaffold systems are temporary structures typically constructed to provide safe access to a building or structure during the construction of a building or when major service is required. A scaffold system provides a safe work platform once the scaffold system is in place and the often includes handrails and/or other safety features to protect the workers.

One of the most common scaffold systems is a tube and clamp system where a series of tubular uprights are secured by releasable clamps to horizontal tubular members as well as diagonal tubular brace members. The tubular upright members are designed to have one end of the tube inserted in the opposite end of a like tubular member to provide an overlapping relationship. The scaffold system is generally built from the ground up and as the height of the scaffold system increases, the men constructing the system are exposed to increased danger. Once the system is in place, the conventional type of safety features, i.e., guardrails, etc. can be installed. Therefore, during the construction of scaffold systems and during dismantling of the scaffold system, the ability to provide a safe work environment is constrained.

Recently, a number of governments have introduced legislation or safety standards which define the safety requirements during the initial erection of a scaffold system as well as during use thereof.

The safety of a worker at an elevated position is a common problem and there are a host of safety lanyard systems which allow a worker to attach the lanyard to the structure and thereby reduce the possibility of serious injury.

The present invention provides a simple arrangement which can easily be secured to a scaffolding system during the erection thereof and provides the workers with a simple arrangement for fastening of a safety lanyard at a worker defined position. The arrangement also can be used for other functions associated with scaffold systems and the repair of buildings.

SUMMARY OF THE INVENTION

An anchor clamp according to the present invention comprises a body portion with a pivoting latch secured thereto. The pivoting latch is movable between a closed position where the latch and body portion define therebetween a pipe engaging recess and an open position allowing access to the pipe engaging recess. The anchor clamp further includes a releasable securing means adapted to draw the pivoting latch towards the body portion reducing the size of the pipe engaging recess and maintaining said pivoting latch in a closed position. The anchor clamp includes a fastening arrangement on the body portion for attaching a further component to said anchor clamp.

According to an aspect of the invention, the fastening arrangement is adapted to receive and retain a hook of a safety lanyard.

In a further aspect of the invention, the fastening arrangement includes a securing loop projecting from one side of the body portion.

In a further aspect of the invention, the securing loop is a metal member fixed on the body portion.

In a different aspect of the invention, the fastening arrangement is pivotally secured to the anchor clamp.

In yet a further aspect of the invention, the fastening arrangement includes a closed loop portion.

In yet a further aspect of the invention, the closed loop portion is fixed on the body portion.

In a different aspect of the invention, the releasable securing means of the anchor clamp includes a captured wedge member which cooperates with the body portion and the pivoting latch to vary the size of the recess in accordance with the position of the wedge.

Tube and clamp scaffold systems according to the present invention, comprises a series of tubular uprights and tubular horizontal members fastened one to the other by means of a series of releasable clamps. The system further includes a series of anchor clamps each providing an anchor position for attachment of a safety lanyard. Each anchor clamp is releasably attached about one of the tubular uprights or the tubular horizontal members.

Each anchor clamp comprises a body portion with a movable latch secured thereto and in a closed position defines a tubular engaging recess therebetween. The movable latch in the closed position cooperates with the body portion and receives one of the tubular members in the recess. The movable latch allows movement thereof relative to the body portion to a position releasing the respective tubular member and accommodating removal of the anchor clamp. The anchor clamp further includes a releasable securing means adapted to draw the pivoting latch towards the body portion reducing the size of the pipe engaging recess and locking the anchor clamp on the scaffold system. Each anchor clamp includes a fastening arrangement on the body portion for attaching a component of a safety lanyard to the anchor clamp.

BRIEF DESCRIPTION OF THE DRAWINGS

Preferred embodiments of the invention are shown in the drawings, wherein:

FIG. 1 is a partial perspective view of a portion of a tube and clamp scaffolding system;

FIG. 2 is a perspective view of the anchor clamp with the pivoting latch in an open position;

FIG. 3 is a top view of the anchor clamp shown in FIG. 2;

FIG. 4 is a side view of the anchor clamp;

FIG. 5 is a side view of the anchor clamp with the latch in an open position;

FIG. 6 is a partial perspective view of a clamp about to be secured to a tube;

FIG. 7 is a perspective view of an alternative clamp;

FIG. 8 is a perspective view of a modified anchor clamp; and

DETAILED DESCRIPTION OF THE PREFERRED EMBODIMENTS

Figure 9:
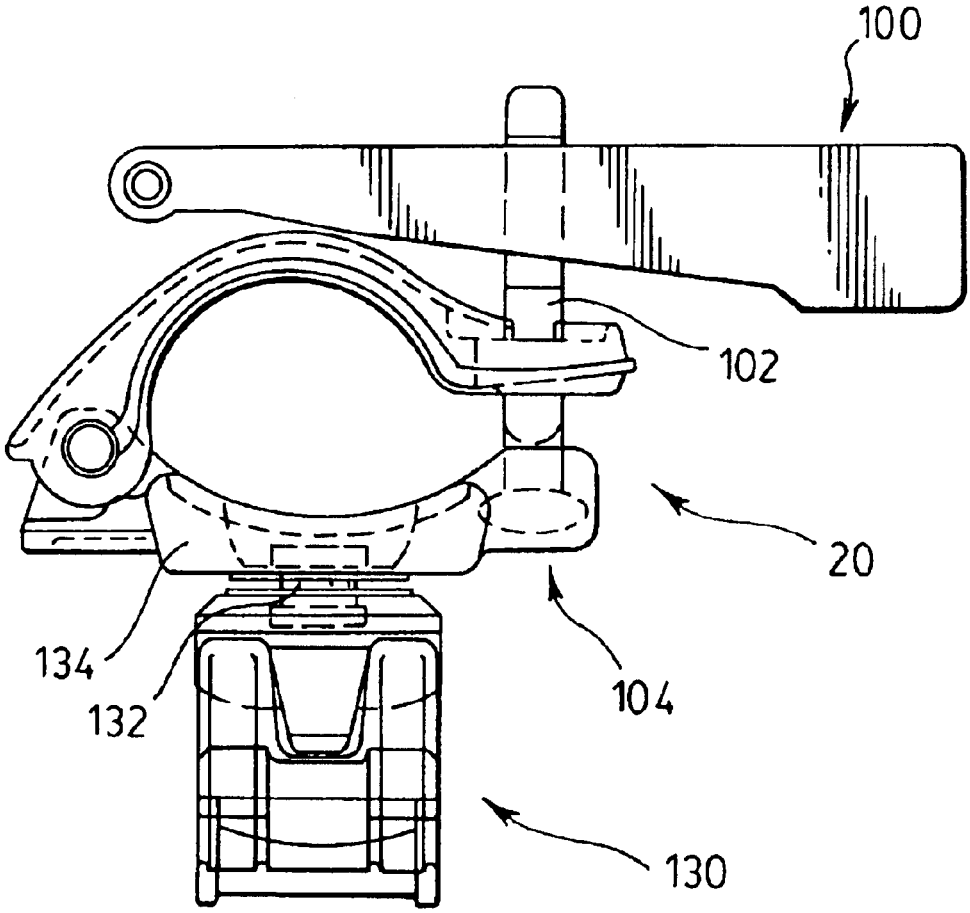
FIG. 9 is a top view of a pivoting anchor clamp.

FIG. 1 shows part of a tube and clamp scaffold system 2 having a series of vertical tubular members 4, connected horizontal tubular members 6 and diagonal tubular brace members 8. The tubular members are connected by means of a series of releasable clamps 10. This type of scaffolding system has been used for building construction and maintenance for at least 20 years and this type of system has the advantage that it is relatively straightforward to erect and can be knocked down and stored efficiently.

The releasable clamps used for connecting a diagonal member to a horizontal or vertical member typically are pivoting clamp arrangements to accommodate variations in the angle of the diagonal to the horizontal or vertical member. The clamps used for connecting a horizontal to a vertical member are typically fixed as the connection should be approximately 90 degrees.

Tubes of clamps 10 can include captured wedge members which cooperates with the pivoting latches of the clamps to secure the clamp to the tubular member. The wedge is brought into an engaging position and typically driven downwardly to a secure position by means of a hammer or other blunt object. When the system is to be taken down, the wedge may be released and the clamps removed.

Once the tube and clamp scaffolding system is in place, it is possible to attach deck boards and guard rails to provide additional safety for the workers, however, the workers who are actually erecting a system are exposed to increased risk. To overcome this deficiency, a series of anchor clamps 20 can be secured to any of the tubular members to provide fastening points for attaching the hook of a safety lanyard to the anchor clamp. In this way, the worker assembling the scaffolding system can appropriately secure an anchor clamp and attach his safety lanyard hook to the anchor clamp.

One such anchor clamp 20 is shown in various views in FIGS. 2 through 5. The anchor clamp includes a body portion 22 which engages and retains a pivoting latch 24. The pivoting latch is movable from the open position of FIG. 2 to a closed position such that the latch and the body portion are positioned about a tubular member. The tubular member is received within the pipe engaging recess 26. A releasable securing arrangement, in this case, a captured wedge 50, is pivotally secured to the latch 24 and can be used to tighten the pivoting latch and the body portion 22 about a tubular member by decreasing the size of pipe engaging recess 26. The captured wedge 50 is one example of a simple mechanical arrangement for clamping of the latch in the body portion about the periphery of a tubular member. Any suitable releasable securing means for drawing of the latch and the body portion about a tubular member can be used. A different securing means is shown in FIG. 9 where a captured wedge 100 cooperates with the slotted bolt 102 rotatably received in the socket 104 of the body portion. To secure the clamp, the wedge and bolt would be rotated 90 degrees and the wedge driven downwardly.

The anchor plate includes a fastening arrangement 30 which includes a base plate 34 and a tapered loop 32. The tapered loop 32 projects outwardly from the base plate and provides an attachment port for engaging a hook of a safety lanyard. The tapered loop is wider at the points of attachment with the base and can be secured thereto by welding. This provides a strong mechanical connection and the loop tapers inwardly to allow securement with different sizes of safety lanyard hooks. Certain safety lanyards have a small hook whereas other safety lanyards have a large hook. The tapered loop allows the anchor plate to be used with either type of lanyard hook.

The body portion 22 of the anchor clamp is defined in this case, with two bent arms 36 which are welded to a plate 31 attached to the base plate 34. Other arrangements for defining the body portion are possible. For example, the entire body portion including the loop could be made by forging or casting. It can also be made as a series of components which are welded or otherwise mechanically secured. Furthermore, it is possible to mechanically fasten the base plate 34 to the body portion to allow pivoting of the base plate and thus a pivoting action of the loop 32.

It has been found that this arrangement provides positive securement of the anchor clamp to a tubular scaffold member and the anchor clamp can withstand the weight of a worker falling if this should occur. Obviously, the anchor clamp is located at some intermediate position within the scaffolding system. The strength of the scaffolding system will be higher and the system is not prone to damage. When a worker is erecting the system, an anchor clamp is typically secured on a projecting upright tubular member and a significant lever action occurs. It has been found that if the anchor clamp is attached at a position at approximately three feet above the last horizontal member, that the anchor clamp will transfer the various loads to the scaffolding system and no failure of the components or the systems will result.

In some cases, there may be damage to the particular tubular member. For example, it may be bent, however, it has been found that it will not fracture.

The system has been tested using a 220 lb. weight attached to the non shock absorbing four foot lanyard. The anchor clamp was attached to one of the vertical tubes about 20 inches above the upper most horizontal connection. A series of different tests were conducted and in all cases, the anchor clamp did not slip on the tubular member. Furthermore, in all cases, the load held and the anchor clamp operated in the intended manner. In some cases, bending of the aluminum tube occurred, however, the extent of the bending was acceptable at being less than 20 degrees. This is more than satisfactory as the tubular member held and the upright member can be scrapped in the event of an actual accident and bending of the tube occurred.

The anchor clamp is specifically designed as a simple arrangement for providing a safety anchor at any point on a tubular scaffolding system. It also has additional uses for securing of the scaffolding system to a building such as a tie off point or for use in suspending of tarps or other structures from the scaffold system. The anchor clamp can also be used as guides for ropes or wires and can be used as a securement point for such ropes or wires.

The anchor clamp 20 of FIG. 9 is a pivoting clamp such that the fastening arrangement 130 pivots about bolt 132 attached to the body portion 134.

The anchor clamp 20 of FIG. 6 is about to be secured by wedge 28 to the tubular member 29 of a scaffolding system.

The anchor clamp of FIG. 7 has a fixed width fastening loop 33 and the anchor clamp of FIG. 8 has two welded bars forming a closed loop with the base plate.

The particular anchor clamp is easy to use by the worker in that he is constantly dealing with releasable clamps for connecting tubular members and the worker can attach an anchor clamp at any desired position. The anchor clamp is also convenient to remove and relocate along any tubular member or from one tubular member to another.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An anchor clamp comprising a body portion with a pivoting latch secured thereto, said pivoting latch being movable between a closed position where said latch and body portion define therebetween a pipe engaging recess and an open position allowing open access to said pipe engaging recess, said anchor clamp further including a releasable securing means adapted to draw said pivoting latch towards said body portion reducing the size of said pipe engaging recess and maintaining said pivoting latch in said closed position, said anchor clamp including a fixed closed loop attachment structure secured on and projecting to one side of said body portion, said closed loop attachment structure having a center port of a size to receive a hook of a safety lanyard; and wherein said closed loop attachment structure includes a tapered loop projecting outwardly from said body portion, said tapered loop being of a wider width adjacent said body portion and tapering to a narrower width adjacent a center point of said tapered loop.

2. The anchor clamp as claimed in claim 1 wherein said closed loop attachment structure is a metal member fixed on said body portion.

3. The anchor as claimed in claim 1 wherein said closed loop attachment structure is pivotally secured to the body portion of said anchor clamp.

4. The anchor clamp as claimed in claim 1 or 3 wherein said releasable securing means includes a captured wedge member which cooperates with said body portion and said pivoting latch to vary the size of said recess in accordance with the position of said wedge.

5. The anchor clamp as claimed in claim 1 wherein said closed loop attachment structure is fixed on said body portion and has a fixed orientation relative to said body portion.

6. The anchor clamp as claimed in claim 5 wherein said closed loop attachment structure is a metal member permanently attached to said body portion.

7. A tube and clamp scaffolding system comprising a series of tubular uprights and tubular horizontal members fastened one to the other by a series of releasable clamps, said system further including a series of anchor clamps with each anchor clamp providing an anchor position for attachment of a safety lanyard; each anchor clamp being releasable attached about one of said tubular uprights and said tubular horizontal members; each anchor clamp comprising a body portion with a movable latch secured thereto and in a closed position of said body portion and latch defining a tubular engaging recess therebetween, said movable latch in a closed position cooperating with said body portion to accommodate one of said tubular members in said recess, said movable latch allowing movement thereof relative to said body portion to a position releasing the respective tubular member and accommodating removal of said anchor clamp, said anchor clamp further including a releasable securing means adapted to draw said pivoting latch towards said body portion reducing the size of said pipe engaging recess and locking said anchor clamp on said scaffold system; said anchor clamp including a fixed closed loop attachment structure secured on said body portion and having a center port sized for receiving and engaging a hook of a safety lanyard and wherein said closed loop attachment structure has a base plate secured to said body portion and a tapered loop integral with and projecting outwardly from said base plate, said tapered loop being of varying width.

8. The scaffolding system as claimed in claim 7 wherein said tapered loop is of a greater width adjacent said base plate and reduces in width towards the center of said tapered loop.

9. The scaffolding system as claimed in claim 8 wherein tapered loop is welded to said base plate.

10. The scaffolding system as claimed in claim 8 wherein said base plate_and said tapered loop are secured to said body portion to define a pivotal connection with said body portion.

* * * * *